US007429159B2

(12) United States Patent
Priest et al.

(10) Patent No.: US 7,429,159 B2
(45) Date of Patent: Sep. 30, 2008

(54) END LOADER BUCKET ATTACHMENT

(76) Inventors: Joe W. Priest, 7114 S. Highway 281, Stephenville, TX (US) 76401; Robert L. Priest, Route 2, Box 190, Abernathy, TX (US) 79336

( * ) Notice: Subject to any disclaimer, the term of this patent is extended or adjusted under 35 U.S.C. 154(b) by 291 days.

(21) Appl. No.: 11/344,247

(22) Filed: Feb. 1, 2006

(65) Prior Publication Data

US 2007/0175071 A1 Aug. 2, 2007

(51) Int. Cl.
*B66F 9/00* (2006.01)

(52) U.S. Cl. ..... 414/724; 37/403; 37/903; 414/912

(58) Field of Classification Search ..... 414/724, 414/912; 37/403, 410
See application file for complete search history.

(56) References Cited

U.S. PATENT DOCUMENTS

| | | | | |
|---|---|---|---|---|
| 2,840,932 | A | 7/1958 | Breyer | |
| D220,617 | S | 5/1971 | Pavese | |
| 3,587,887 | A | 6/1971 | De Carli | |
| 3,805,422 | A | 4/1974 | Stepe | |
| 3,812,979 | A | 5/1974 | Leihgeber | |
| 4,200,423 | A | 4/1980 | Sornsin | |
| D292,136 | S | 9/1987 | Burenga | |
| 5,071,311 | A | 12/1991 | Foster et al. | |
| 5,242,152 | A | 9/1993 | Schatz | |
| D376,372 | S | 12/1996 | Little et al. | |
| 5,921,302 | A | 7/1999 | Petersen | |
| 6,101,702 | A * | 8/2000 | Claycomb et al. | 29/426.4 |
| 6,669,172 | B1 | 12/2003 | Bearden | |
| 6,729,051 | B1 | 5/2004 | Hollen | |
| 6,764,139 | B1 | 7/2004 | Wortman | |

FOREIGN PATENT DOCUMENTS

JP 5-112962 5/1993

OTHER PUBLICATIONS

"http://www/chinadepot.com/zl50berlin.html" Fronte-End Loader Model ZL-50, three pages, printed Oct. 17, 2005.

* cited by examiner

*Primary Examiner*—Donald Underwood
(74) *Attorney, Agent, or Firm*—Richard C. Litman

(57) ABSTRACT

The end loader bucket attachment includes a bracket attachable to the side plate of an end loader bucket, and an arm pivoting from the bracket. The pivot is oriented generally vertically to allow the arm to swing in a generally horizontal plane, depending upon the tilt of the bucket. When the bucket is tilted somewhat rearwardly, the weight of the arm causes it to swing outwardly to extend generally laterally from the bucket and end loader machine. However, when the bucket is tilted somewhat forwardly, the arm automatically swings forwardly, generally parallel to the longitudinal axis of the machine. The attachment is particularly useful in picking up suspended objects to the side of the bucket and machine, and swinging those loads to a forward position generally in front of the bucket and machine. This greatly reduces the need for maneuvering the machine to pick up and reposition such loads.

18 Claims, 5 Drawing Sheets

END LOADER BUCKET ATTACHMENT

BACKGROUND OF THE INVENTION

1. Field of the Invention

The present invention relates generally to powered earthmoving and cultivating equipment, such as tractors, skid loaders, end loaders, and the like. More particularly, the present invention comprises a gravity actuated swing arm or boom that may be removably attached to one side or end of an end loader bucket for picking up and moving objects from the side of the bucket to a position generally forward of the bucket, or the opposite maneuver.

2. Description of the Related Art

Agricultural and earthmoving equipment are commonly equipped with hydraulically actuated earthmoving buckets. Many such machines are equipped with such buckets as integral components of the machines, while other machines may be equipped with such buckets as aftermarket add-on components. The end loader bucket has proven to be a very versatile device, suitable not only for earthmoving and landscaping operations, but also for the loading, unloading, and carriage of a wide variety of different materials as desired.

A number of different attachments have been developed for such end loader buckets and assemblies in order to provide even greater versatility for the devices. However, such devices are generally limited in their utility and are immovably affixed to the bucket or its supporting structure, or manually adjusted thereon. An example of such a device is found in Japanese Patent Publication No. 5-112,962 published on May 7, 1993. This device (according to the drawings and English abstract) is a sod cutting blade, which is installed in a permanently affixed socket within the center of a power shovel or bucket. The blade may be turned manually to cut either lateral or longitudinal grooves in sod, depending upon the orientation of the blade and the machine to which it is attached. Due to its essentially vertical disposition and symmetry, the blade cannot rotate or swing due to gravity as the bucket is tilted. Any change in blade angle must be accomplished manually.

None of the above inventions and patents, taken either singly or in combination, is seen to describe the instant invention as claimed. Thus, an end loader bucket attachment solving the aforementioned problems is desired.

SUMMARY OF THE INVENTION

The end loader bucket attachment comprises a bracket attached (e.g., bolted, pinned, welded, etc.) to the side face of the bucket of an end loader machine (tractor, skid loader, etc.). A gravity actuated swing arm is pivotally secured to the bracket, with the arm being free to swing from a forwardly disposed position wherein its forward motion is stopped by the side face of the bucket (and/or any other stop means provided), and its rearward or sideward motion is stopped at about ninety degrees to the forward limit by a stop provided with the attachment bracket. One or more telescoping extensions may be provided from the swing arm, as desired.

The device is particularly useful in lifting objects or loads suspended therefrom and maneuvering them to another location without requiring the machine or vehicle to be turned to align the bucket with the object or load or its initial location. The bucket is tilted rearwardly to cause the swing arm to swing slightly downwardly and rearwardly due to gravity. This allows the now laterally disposed swing arm to be maneuvered to pick up a laterally displaced object or load without the need to turn the machine to align the machine or bucket with the object or load. Once the load has been hoisted by the laterally disposed boom or arm, the bucket may be tilted slightly forwardly, thereby causing the arm to swing slightly downwardly and around to its forward stop. This allows the load to be carried generally to the front of the bucket and machine, so that the load may be deposited in a location forward of the machine with little or no need for lateral maneuvering of the machine. The result is the greatly facilitated handling of loads and objects, which may be suspended from the arm or boom, and a significant reduction in the time required for such loading or unloading.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a swing arm attachment for an end loader bucket for picking up or depositing objects displaced laterally from the bucket, and from the vehicle to which the bucket is attached, and depositing or picking up those objects to or from a location in front of the bucket and vehicle. The device is fully automatic in its operation and depends solely upon gravity for actuation due to the tilt of the end loader bucket.

Figure 1:
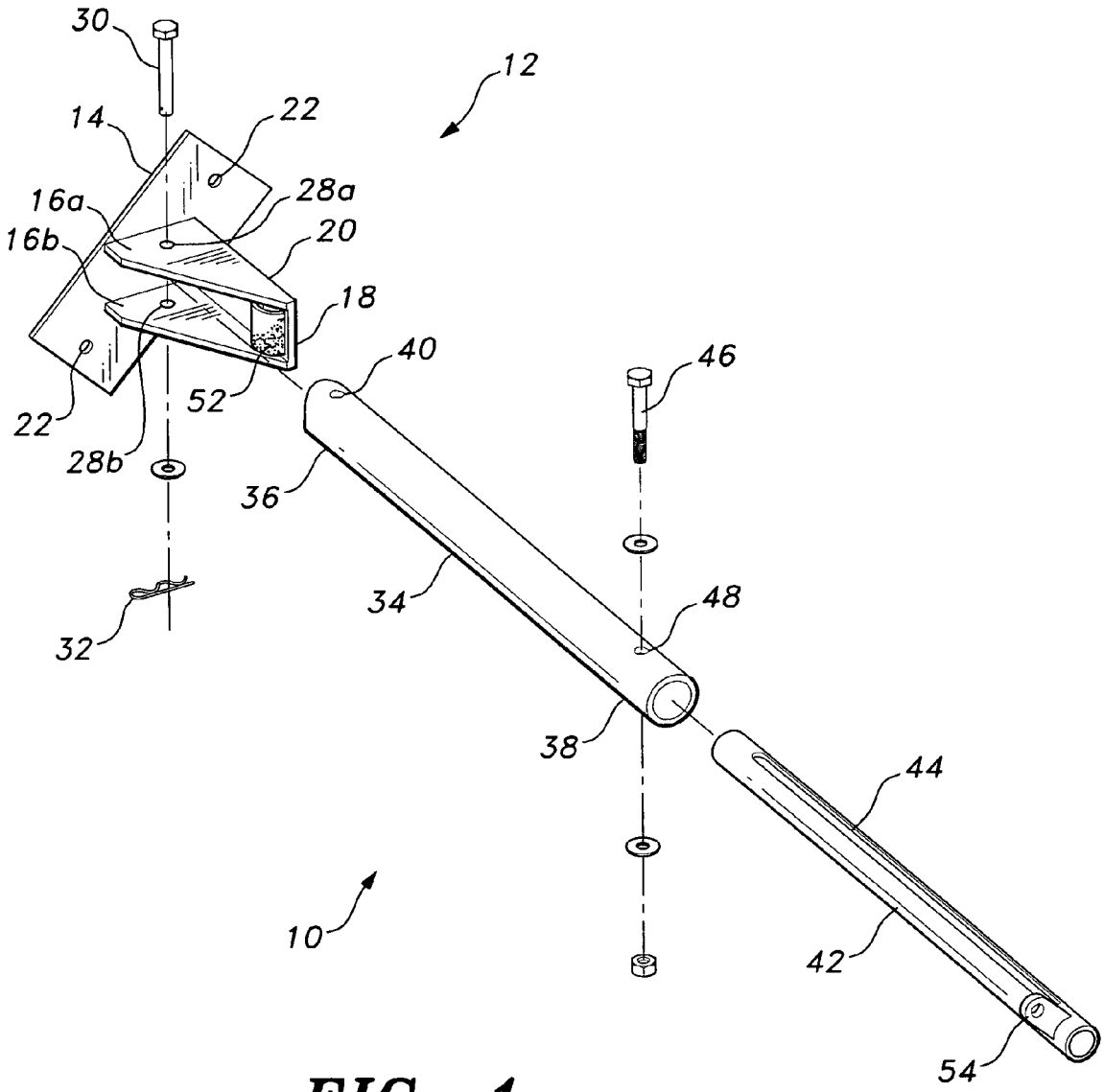
FIG. 1 is an exploded perspective view of a first embodiment of an end loader bucket attachment according to the present invention, showing its various features and details.

FIG. 1 of the drawings provides an exploded perspective view of a first embodiment of the present bucket attachment 10. The assembly includes a bucket side plate attachment bracket 12, which is, in turn, formed of four basic components. The first of these is a flat side plate mounting plate 14, from which first and second parallel, spaced apart swing arm plates 16*a* and 16*b* extend. The swing arm plates 16*a*, 16*b* are substantially normal to the plane of the side plate mounting plate 14. A web plate 18 extends between the two swing arm plates 16*a*, 16*b* normal to the mounting plate 14 and the two swing arm plates 16*a*, 16*b*, and ties their rearward edges 20 together. The various plates 14 through 18 are preferably formed of a fairly thick steel plate (e.g., ¼ inch, more or less, depending upon the required strength for the application), but other materials and thicknesses may be used as desired. The various components 14 through 18 are preferably welded together, but the two swing arm plates 16*a*, 16*b* and web plate 18 may be provided as a short, unitary length of heavy channel, if so desired.

The mounting plate 14 may be welded to the side plate of the end loader bucket, if so desired, but the present disclosure provides for the removal of the assembly 10 from the bucket for greater versatility of the end loader bucket. A series of side plate fastener mounting holes 22 is provided through the mounting plate 14 for placement over a corresponding series of pins 24 (shown in FIG. 2) extending from the side or end plate P of the end loader bucket B. The pins 24 may be draw pins temporarily or permanently secured to the side plate P of the bucket B, with linchpins 26, conventional hitch pins, etc. being used to secure the mounting plate 14 (and thus the entire bucket attachment 10) to the draw pins 24. Alternatively, the mounting plate 14 may be secured to the end plate P of the bucket B by conventional threaded bolts and nuts, if so desired. Many end loader buckets B are provided with existing holes in their side or end plates P for the attachment of lifting hooks or other accessories, and the holes 22 in side plate mounting plate 14 may be formed by drilling the holes 22 to align with these existing holes (if provided).

Each of the two parallel swing arm plates 16*a*, 16*b* includes a pivot pin passage, respectively 28*a*, 28*b*, therethrough. A pivot pin 30 (e.g., bolt, clevis pin, etc.) is installed through the two pivot pin passages 28*a*, 28*b* to secure the swing arm to the bracket 12. A hitch pin 32 may be used to secure the pivot pin 30 in place when a clevis pin is used, or a conventional threaded nut may be used to secure a threaded bolt.

The various embodiments of the end loader bucket attachment 10, 10*a* differ primarily in the swing arm or extension arm, which pivots from the bucket mounting bracket 12. The bucket attachment embodiment 10 of FIGS. 1 and 3 includes a multiple piece, telescoping swing arm, whereas the embodiment 10*a* of FIGS. 2, 4, and 5 has only a single piece arm. Both of the embodiments 10 and 10*a* include an elongate swing arm 34 having a proximal end 36 and an opposite distal end 38, with the proximal end 36 having a diametric pivot pin passage 40 formed therethrough. The pivot pin 30 passes through the pivot pin passages 28*a*, 28*b* of the two swing arm plates 16*a*, 16*b* and the pivot pin passage 40 of the swing arm 34 to pivotally secure the swing arm 34 between the two swing arm plates 16*a*, 16*b*. In the single length embodiment 10*a* of FIGS. 2, 4, and 5, the swing arm 34 may comprise a solid rod or bar, but preferably the swing arm of both embodiments is formed of a length of heavy wall pipe or the like.

Figure 3:
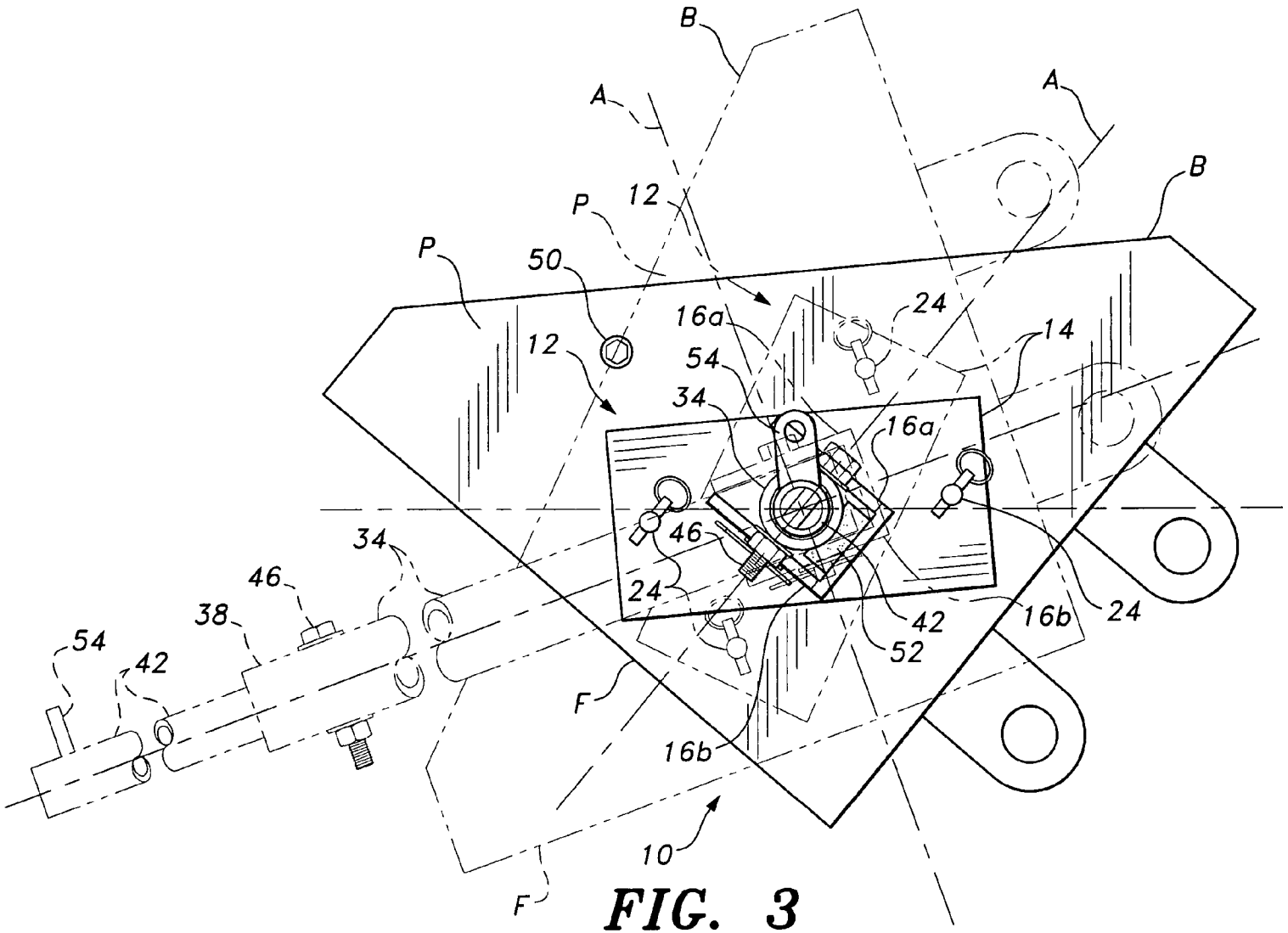
FIG. 3 is an environmental side elevation view of the present attachment installed upon the side plate of an end loader bucket, showing how the tilt of the bucket affects the position of the swing arm.

In the embodiment 10 of FIGS. 1 and 3, the swing arm is formed of two telescoping lengths of material, with the outer or second length 42 telescoping concentrically into the hollow pipe of the first length 34. The second length 42 preferably includes two diametrically opposed axial slots 44 (one of which is shown in FIG. 1), with an extension stop bolt or pin 46 (e.g., threaded bolt and nut assembly, as shown in FIGS. 1 and 3) passing through a stop pin passage 48 formed through the distal end 38 of the first swing arm length 34 and through the slots 44 of the outer or second swing arm length 42. This allows the second length 42 to be extended from the first length 34 to the extent of the slots 44, while preventing the second length 42 from separating from the first length 34. It will be seen that numerous alternative means of securing the second swing arm length to the first swing arm length may be provided, e.g., reversing the two lengths so the larger diameter length is distal to the bracket 12; slotting the larger diameter length, or providing slots extending partially along each length; providing a larger diameter flange on the smaller diameter length and a stop inside the larger diameter length; etc. More than two mutually telescoping segments may be provided, if so desired, but it is preferable that the telescoping configuration be limited to two sections, as shown, in order to avoid excessive length, bending loads on the arms and attachment bracket, and an excessively long lateral moment on the weight being lifted in order to avoid tipping the end loader.

Figure 2:
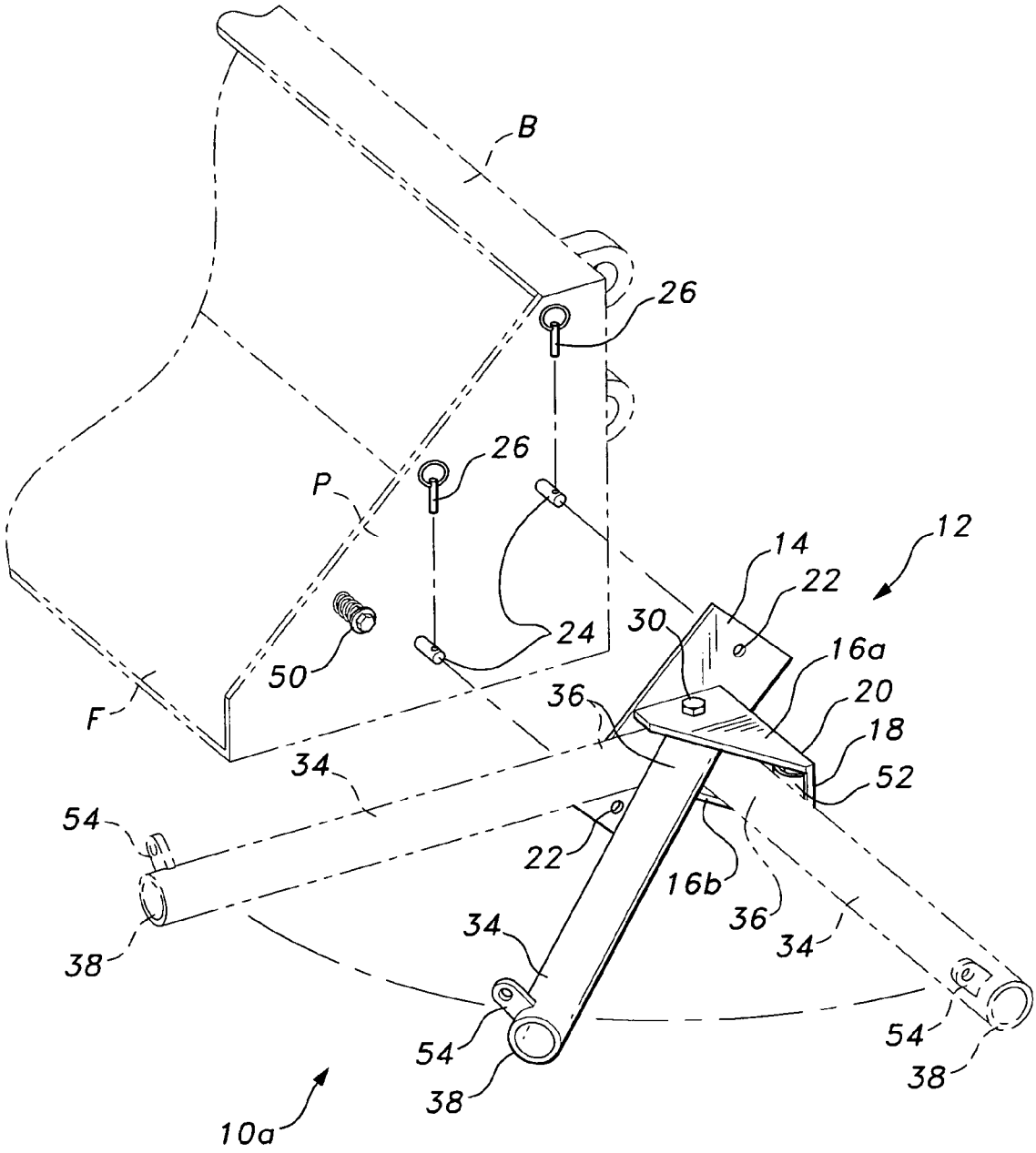
FIG. 2 is an exploded environmental perspective view of a second embodiment of the present end loader bucket attachment, showing its removable installation upon the side face or plate of an end loader bucket.

FIG. 2 illustrates both the installation of the single swing arm length assembly 10*a* to the side plate P of an end loader bucket B, as well as operation of the swing arm 34. The swing arm 34 is free to swing back and forth about its pivot bolt or pin 30 through the two swing arm plates 16*a*, 16*b*, with the motion of the swing arm 34 limited only by the web plate 18 extending between the rear edges 20 of the two plates 16*a*, 16*b* and by the side plate P of the bucket B to which the assembly 10*a* is attached. Preferably, a cushioned forward extension stop 50 is provided to cushion the impact of the swing arm 34 as it swings to its forwardmost position against the side plate P of the bucket B. The extension stop 50 comprises a bolt or pin extending through a hole or passage in the side plate P of the bucket B, with a spring between the side plate P and the head of the bolt or pin to allow the head of the bolt or pin to compress toward the side plate P and cushion the shock of the swing arm 34 as it contacts the stop 50.

Similarly, a cushioned rear or lateral extension stop 52 may be provided as well, if so desired. Such a stop 52 may comprise a hard rubber block or the like disposed within the web plate 18, or, alternatively, a spring-cushioned bolt similar to the forward cushion stop 50 discussed above. Generally, there will be little or no load on the arm 34 as it swings to its laterally extended position. However, the rear or lateral stop cushion 52 may be included, if so desired, or if it is felt that it would be beneficial in certain operations.

FIG. 3 illustrates the operation of the end loader bucket attachment, particularly the embodiment 10 thereof. However, it should be noted that both embodiments 10 and 10*a* operate in essentially the same manner, with the exception of the telescoping distal section or length 42 of the attachment embodiment 10. The end loader bucket B is conventional and articulates conventionally, i.e., the bucket B may be raised, lowered, and tilted forwardly and rearwardly, as desired. The bucket B is shown with its floor F tilted rearwardly in solid lines in FIG. 3, with the opposite forward tilt of the floor F being shown in broken lines in FIG. 3. The attachment 10 (or 10*a*) is installed with the pivot axis A defined by the pivot bolt or pin 30 substantially normal to the plane of the floor F and parallel to the plane of the side plate P of the end loader bucket B.

When the bucket B is tilted rearwardly, as shown in solid lines in FIG. 3, the swing arm 34 (and its distal telescoping extension 42, if so equipped) will swing rearwardly and outwardly due to the upward and rearward inclination of the pivot bolt or pin 30 and its pivot axis A. The arm 34 will generally have some slight outward angle relative to the longitudinal axis of the end loader vehicle when the vehicle is laterally level due to the forward extension stop 50. This provides a downward vector to cause the arm 34 to seek a lower position by pivoting about the pivot bolt 30 and its axis A due to gravity, until it is stopped in an essentially laterally extended position by the web plate 18 and/or any lateral extension stop 52. This positions the arm 34 (and telescoping extension 42, if provided) to extend substantially laterally and normal to the side plate P of the bucket B and the longitudinal axis of the machine, where the arm and/or extension may be used to pick up or deposit objects located to the side of the machine without the need to turn or maneuver the machine laterally to pick up or deliver those objects into or from the bucket B.

When the end loader bucket B is tilted forwardly, the pivot bolt 30 and its pivot axis A rotate to an upwardly forward and downwardly rearward inclination. This causes the weight of the arm 34 (again, with its telescoping extension, if so equipped) to cause the arm assembly to pivot forwardly and downwardly due to gravity, where the arm assembly is stopped in a substantially forward orientation substantially parallel to the plane of the end plate P of the end loader bucket B as the arm 34 contacts the end plate P or cushioned forward extension stop 50. This action carries any load being carried on the arm assembly from a laterally displaced position to a position substantially aligned with the left edge or end of the end loader bucket B, thus precluding (or at least greatly reducing) any requirement to maneuver the vehicle or machine laterally to position the load.

Figure 4:
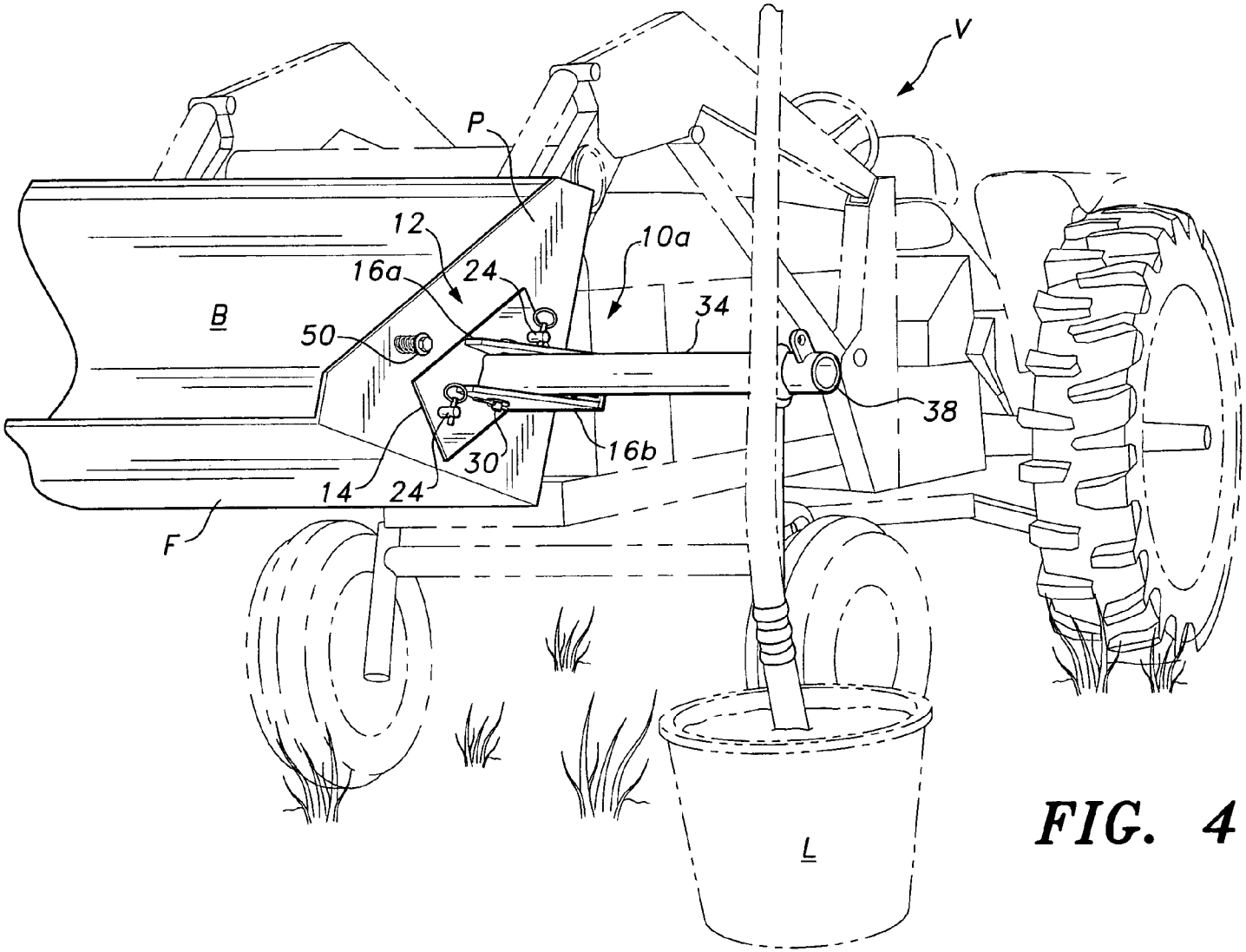
FIG. 4 is an environmental perspective view of the present attachment installed on an end loader bucket, with the bucket tilted rearwardly to swing the arm to the side for picking up an object.
Figure 5:
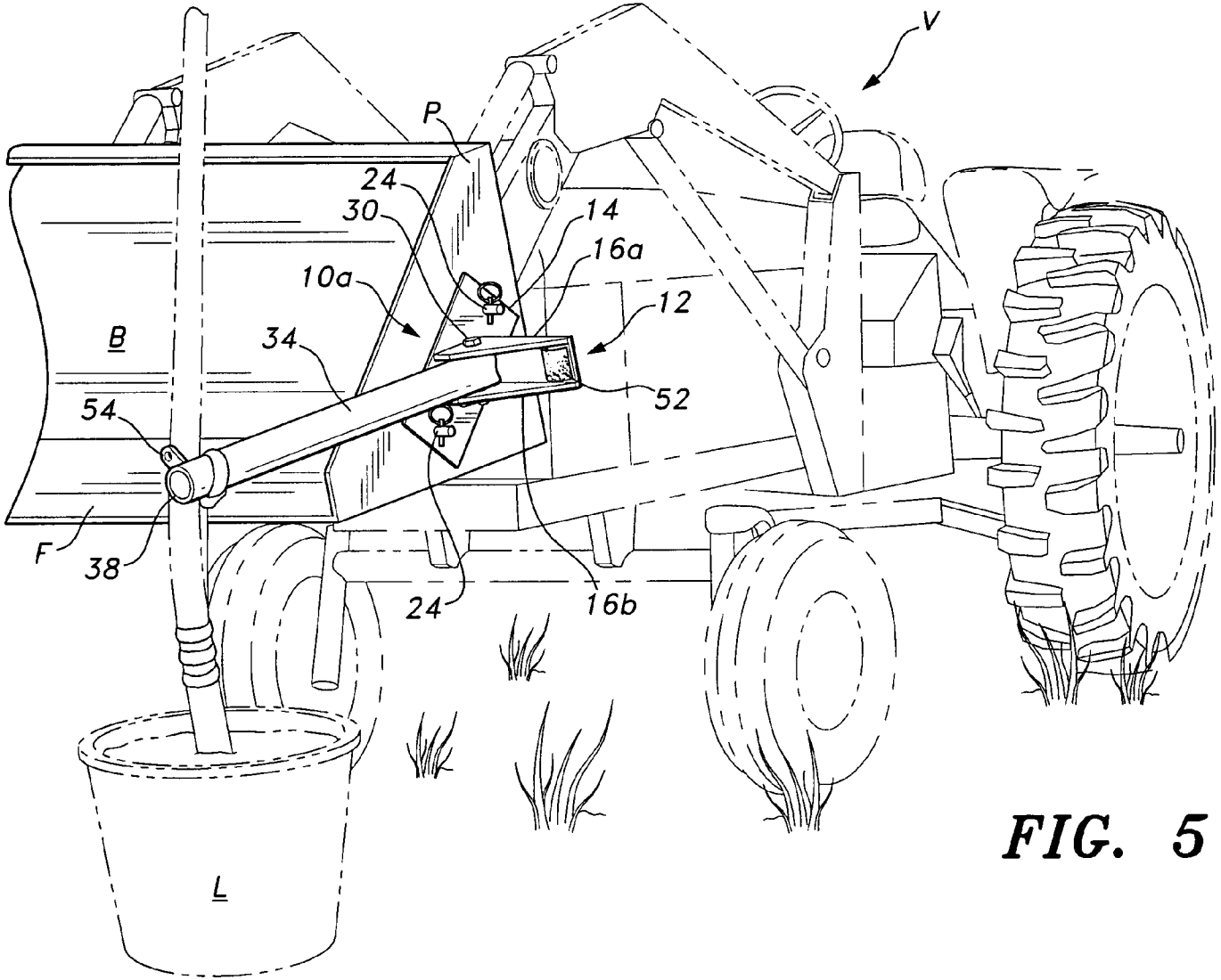
FIG. 5 is an environmental perspective view similar to FIG. 4, but showing the bucket tilted forwardly to swing the arm and its load to a forwardly disposed position.

FIGS. 4 and 5 provide environmental views of an end loader vehicle V, e.g., a tractor, equipped with an articulating end loader bucket B, with the bucket B tilted rearwardly and forwardly in the two views to illustrate the operation of the swing arm described above and shown in FIG. 3. In FIG. 4, the end loader bucket B is tilted rearwardly, i.e., with its floor F inclined downwardly and rearwardly. This angles the swing arm pivot axis and pivot bolt or pin 30 upwardly and rearwardly, so that the swing arm 34 falls or swings downwardly and rearwardly about the pivot axis to a laterally extended position due to gravity. This allows the operator of the end loader vehicle V to drive the vehicle straight ahead, even though the load to be lifted is displaced to the side of the vehicle. The load L (e.g., a potted tree or plant, etc.) may then be secured to the laterally extended arm 34 (e.g., by a strap wrapped about the arm 34 and trunk of the tree or plant), and the end loader bucket B may be raised by means of the conventional hydraulic controls in order to lift the load L. A lifting lug 54 may be provided at the distal end 38 of the arm 34, or at the distal end of the extension 42 as shown in FIGS. 1 and 3, for the attachment of a lifting chain or cable, etc., as desired.

Once the load L has been lifted clear of the underlying surface by means of the end loader bucket B and swing arm attachment 10 (or 10*a*), the end loader bucket B is tilted forwardly to angle the swing arm pivot axis and pivot bolt 30 to a slightly forward and upward inclination. This positions the plane of the swing arm at a forward and slightly downward angle, with the swing arm 34 and its load L automatically swinging forwardly and inwardly due to gravity to a position generally as shown in FIG. 5. The end loader vehicle V may then be driven straight forward to relocate the load L as desired, e.g., in the bed of a pickup truck being driven just ahead of the end loader vehicle. If the desired relocation point of the load is aligned with the left side of the end loader bucket B, and therefore with the forwardly positioned swing arm 34 as shown in FIG. 5, neither vehicle need be maneuvered laterally to manipulate the load L during the pick up and loading process.

In conclusion, the end loader bucket attachment 10 or 10*a* in its various embodiments provides a labor saving device that will be much appreciated by anyone who has need to lift and manipulate objects by means of an end loader bucket. The attachment 10, 10*a* may be removably or permanently secured to the side plate of an end loader bucket of virtually any configuration. Moreover, virtually any end loader configuration is adaptable for installation and use of the present device, including aftermarket end loader bucket assemblies for installation on an existing tractor or the like, dedicated specialty end loader vehicles, skid loaders, and even backhoes and the like. The end loader bucket attachment 10, 10*a* is particularly useful in the field of tree farming, where relatively heavy and bulky saplings, along with their planter buckets, must be lifted from the ground for transport to a nursery, garden center, or permanent installation. However, anyone who has need to lift heavy loads and manipulate or maneuver those loads to a vehicle or other location ahead of the lifting vehicle will appreciate the reduction of labor and simplification of the operation provided by the end loader bucket attachment 10, 10*a*.

It is to be understood that the present invention is not limited to the embodiments described above, but encompasses any and all embodiments within the scope of the following claims.

We claim:

1. An attachment for an end loader bucket, the bucket having at least one side plate and a floor, the attachment comprising:

a side plate attachment bracket defining a pivot axis generally normal to the floor of the bucket and generally parallel to the side plate of the bucket, the bracket being adapted for attachment to the side plate of the bucket, wherein said side plate attachment bracket comprises;

a mounting plate adapted for attachment to the side plate of the bucket;

first and second parallel, spaced apart swing arm pivot plates extending from the mounting plate generally normal thereto, each of the pivot plates having a pivot pin passage defined therethrough and a rearward edge; and a web plate joining the rearward edges of the pivot elates and the mounting plate, the web elate being normal to the pivot plates and the mounting plate;

a cushioned lateral extension stop disposed within said web plate; and a swing arm pivotally secured to the side plate attachment bracket and pivoting about the pivot axis, the swing arm pivoting outwardly to extend laterally from the side plate of the bucket when the bucket is tilted rearwardly with the floor of the bucket inclined downwardly and rearwardly, and pivoting forwardly to extend generally parallel to the side plate when the bucket is tilted forwardly with the floor of the bucket inclined downwardly and forwardly.

2. The attachment for an end loader bucket according to claim 1, wherein said swing arm comprises:

a first section extending from said side plate attachment bracket; and a second section selectively extending telescopically and concentrically from said first section.

3. The attachment for an end loader bucket according to claim 2, wherein:

said first section comprises a hollow tube; and said second section is slidably disposed within said first section.

4. The attachment for an end loader bucket according to claim 1, further including a swing arm extension stop attached to the first and second sections precluding separation of said second section from said first section.

5. The attachment for an end loader bucket according to claim 1, wherein said swing arm has a proximal end having a pivot pin passage formed therethrough, the attachment further comprising a pivot pin extending through the pivot pin passage of each of said swing arm pivot plates and the pivot pin passage of said swing arm.

6. The attachment for an end loader bucket according to claim 1, wherein said mounting plate has a plurality of side plate fastener mounting holes defined therethrough.

7. The attachment for an end loader bucket according to claim 1, further including a cushioned forward extension stop adapted for attachment to the side plate of the bucket forward of the mounting plate in order to stop forward extension of said swing arm.

8. The attachment for an end loader bucket according to claim 1, wherein said swing arm has a distal end, the attachment further comprising a lifting lug extending radially from the distal end.

9. An end loader bucket, comprising:

a bucket adapted for attachment to a vehicle having controls for raising and tilting the bucket, the bucket having a floor and at least one side plate disposed at an end of the floor;

a side plate attachment bracket attached to the side plate, the bracket defining a pivot axis generally normal to the floor of the bucket and generally parallel to the side plate; and a swing arm pivotally secured to the bracket and pivoting about the pivot axis, the swing arm pivoting outwardly to extend laterally from the side plate of the bucket when the bucket is tilted rearwardly with the floor of the bucket inclined downwardly and rearwardly, the swing arm pivoting forwardly to extend generally parallel to the side plate when the bucket is tilted forwardly with the floor of the bucket inclined downwardly and forwardly.

10. The end loader bucket according to claim 9, wherein said swing arm comprises:

a first section extending from said side plate attachment bracket; and a second section selectively extending telescopically and concentrically from the first section.

11. The end loader bucket according to claim 10, wherein:

said first section comprises a hollow tube; and said second section is slidably disposed within said first section.

12. The end loader bucket according to claim 9, further including a swing arm extension stop attached to said first and second sections for precluding separation of said second section from said first section.

13. The end loader bucket according to claim 9, wherein said side plate attachment bracket comprises:

a mounting plate attached to the side plate of said bucket;

first and second parallel, spaced apart swing arm pivot plates extending from the mounting plate generally normal thereto, each of the pivot plates having a pivot pin passage extending therethrough and a rearward edge; and a web plate joining the rearward edges of the pivot plates and the mounting plate, the web plate being generally normal to the pivot plates and the mounting plate.

14. The end loader bucket according to claim 13, wherein said mounting plate is welded to the side plate of said bucket.

15. The end loader bucket according to claim 13, wherein said mounting plate has a plurality of side plate fastener mounting holes defined therethrough, the end loader bucket further comprising:

a plurality of draw pins extending from the side plate of said bucket through the holes in said mounting plate; and a hitch pin removably inserted through each of the draw pins, whereby said bracket is removably attached to the side plate of said bucket.

16. The end loader bucket according to claim 13, further including a cushioned lateral extension stop disposed within said web plate.

17. The end loader bucket according to claim 9, further including a cushioned forward extension stop extending from the side plate of said bucket forward of said mounting plate for stopping forward extension of said swing arm.

18. The end loader bucket according to claim 9, wherein said swing arm further has a distal end, the end loader bucket further comprising a lifting lug extending generally radially from the distal end of said swing arm.

* * * * *